US008066202B2

(12) United States Patent
Lee

(10) Patent No.: US 8,066,202 B2
(45) Date of Patent: Nov. 29, 2011

(54) FLUID JETTING APPARATUS

(76) Inventor: Heeyoung Lee, Gunsan-si (KR)

( * ) Notice: Subject to any disclaimer, the term of this patent is extended or adjusted under 35 U.S.C. 154(b) by 0 days.

(21) Appl. No.: 12/528,442

(22) PCT Filed: Feb. 21, 2008

(86) PCT No.: PCT/KR2008/001033
§ 371 (c)(1),
(2), (4) Date: Jun. 24, 2010

(87) PCT Pub. No.: WO2008/103003
PCT Pub. Date: Aug. 28, 2008

(65) Prior Publication Data

US 2010/0252657 A1 Oct. 7, 2010

(30) Foreign Application Priority Data

Feb. 23, 2007 (KR) ..... 10-2007-0018590

(51) Int. Cl.
*B05B 9/04* (2006.01)

(52) U.S. Cl. ..... 239/373; 239/327; 239/329; 239/337; 222/95; 222/99; 222/105

(58) Field of Classification Search ..... 239/327, 239/328, 330, 337, 329, 373; 222/95, 99, 222/105
See application file for complete search history.

(56) References Cited

U.S. PATENT DOCUMENTS 4,981,238 A * 1/1991 Wenmaekers ..... 222/95
5,060,700 A * 10/1991 Wenmaekers ..... 222/105
5,221,050 A * 6/1993 Jeffries et al. ..... 239/327

* cited by examiner

*Primary Examiner* — Steven J Ganey
(74) *Attorney, Agent, or Firm* — John K. Park; Park Law Firm

(57) ABSTRACT

Disclosed therein is a fluid jetting apparatus. The fluid jetting apparatus includes: a nozzle having a jetting hole adapted to jet a fluid; a nozzle opening and closing part adapted to open and close the jetting hole; at least one elastic fluid-storing part adapted to store the fluid therein and connected with the nozzle at a portion thereof in such a way as to jet the fluid by its elasticity through the jetting hole, the elastic fluid-storing part increasing elasticity accumulated by receiving the external force; and a pressurizing part adapted to increase elasticity accumulated in the elastic fluid-storing part by applying the force to the elastic fluid-storing part. The fluid jetting apparatus is applied to various devices, such as a sprayer, an atomizer, an oral cleaner, and so on, for jetting materials of a liquid, gas or gel type to thereby jet the fluid with a strong jetting force in a convenient manipulation.

16 Claims, 7 Drawing Sheets

[Fig. 1]
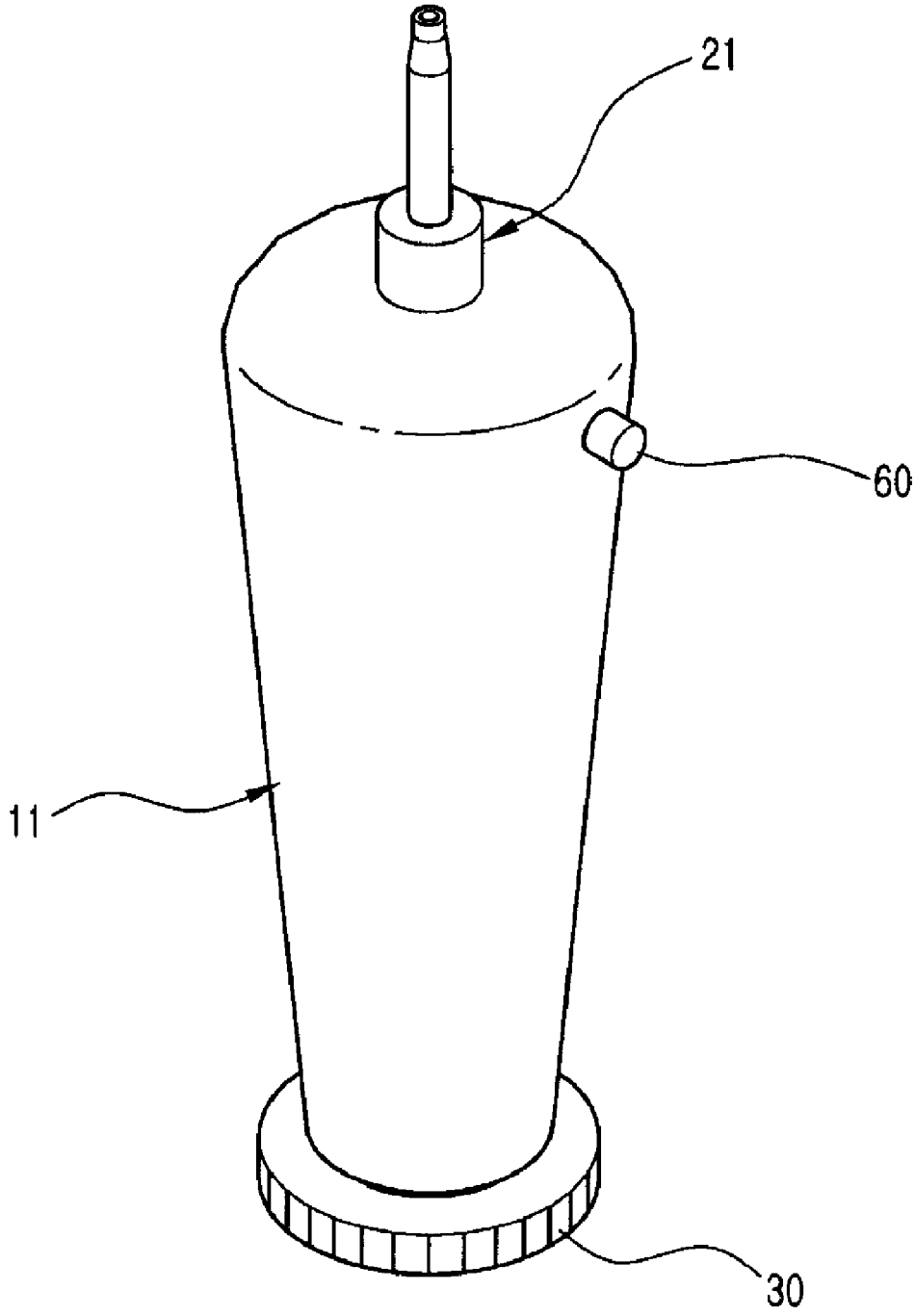

[Fig. 2]
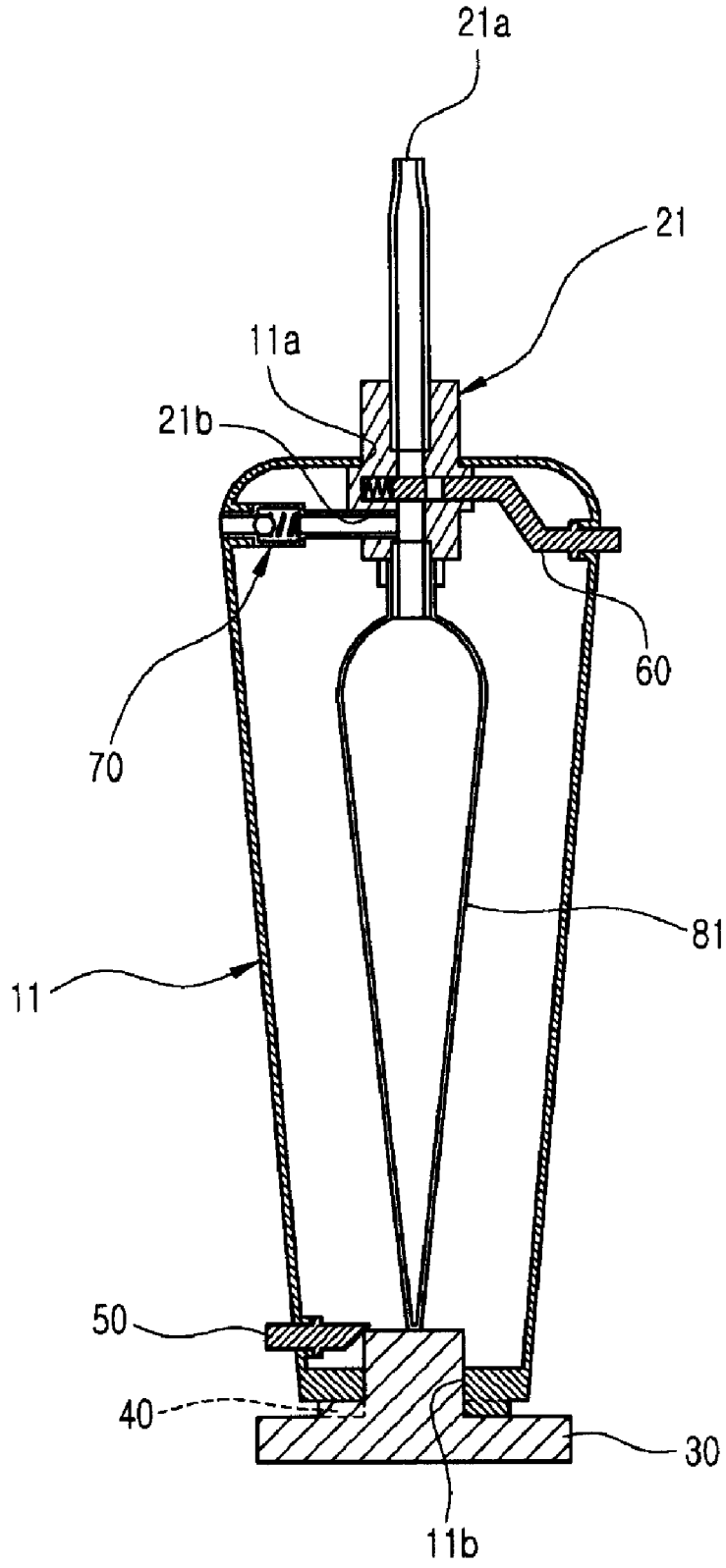

[Fig. 3]
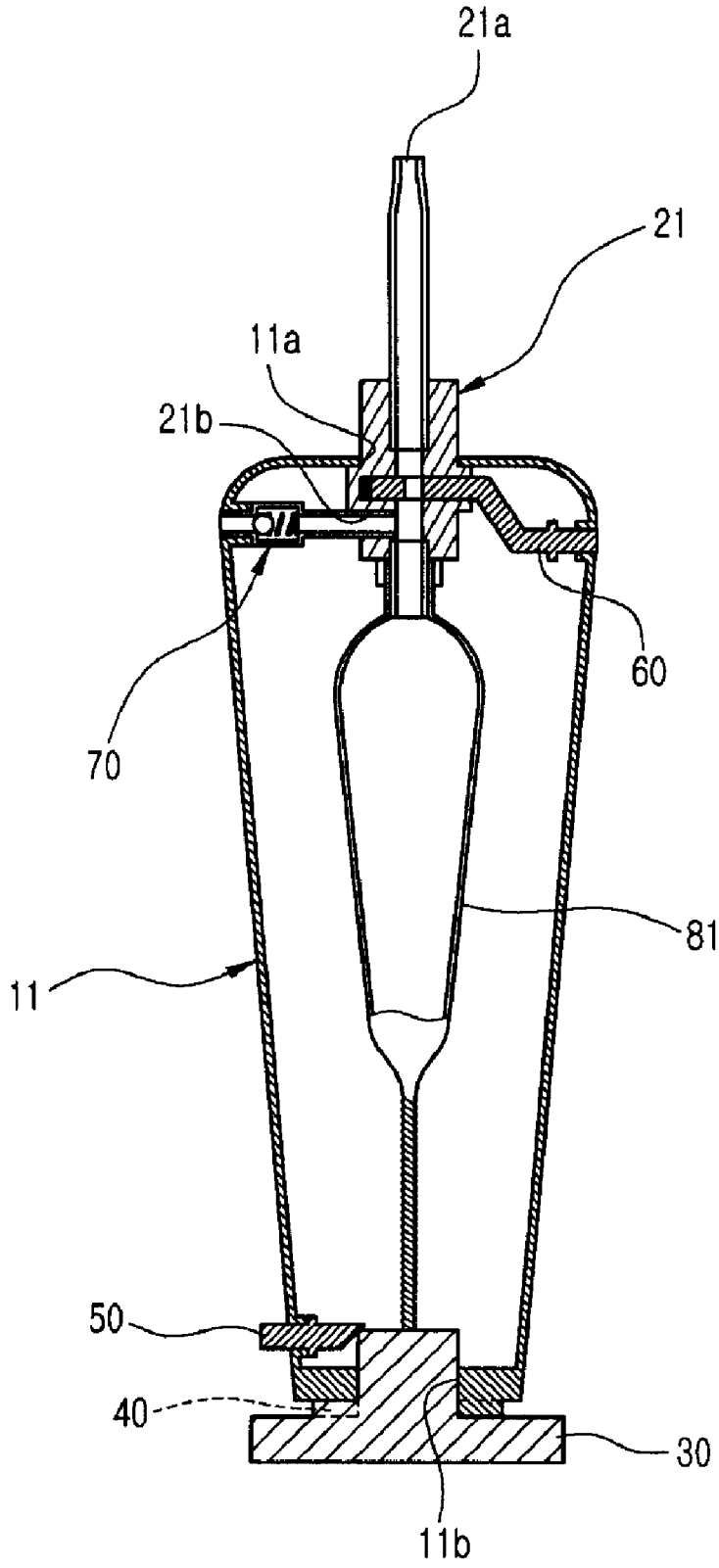

[Fig. 4]
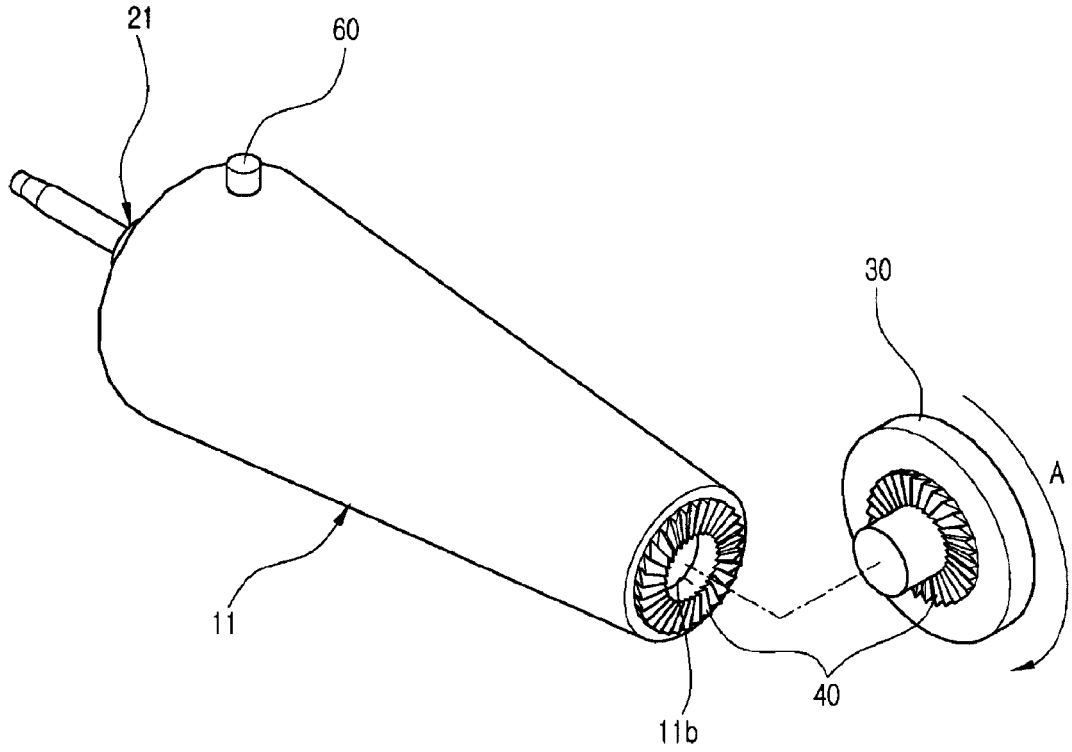

[Fig. 5]
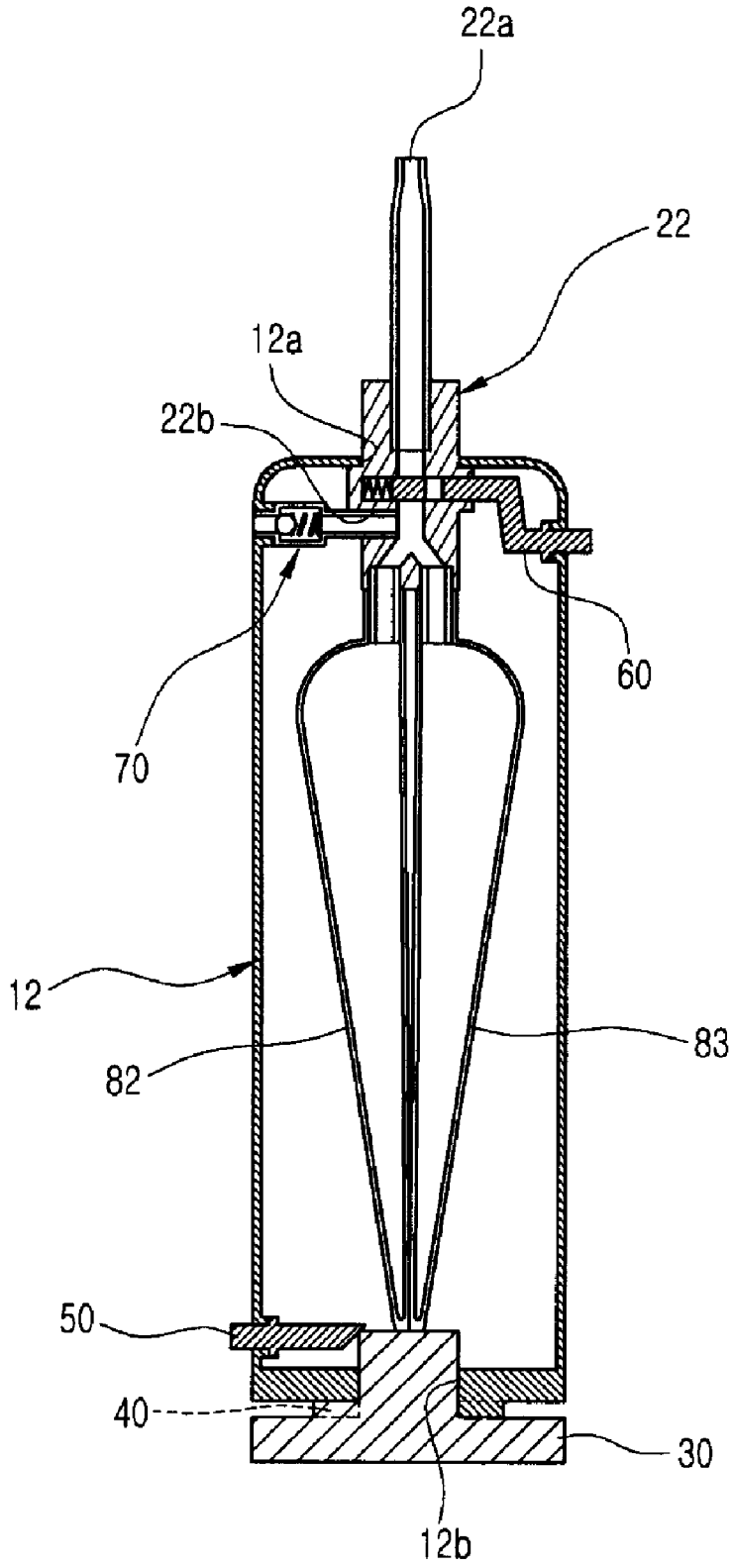

[Fig. 6]
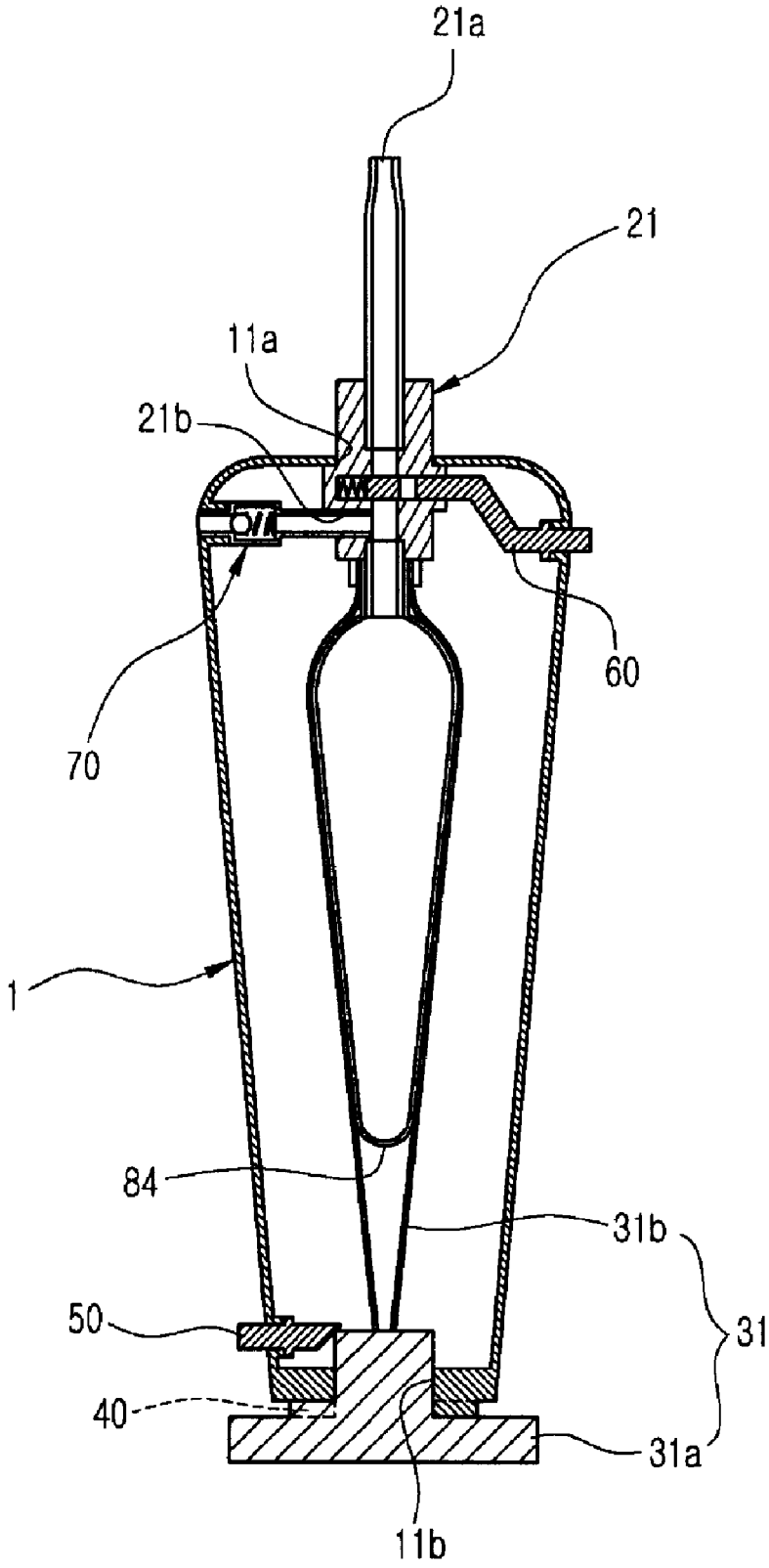

[Fig. 7]
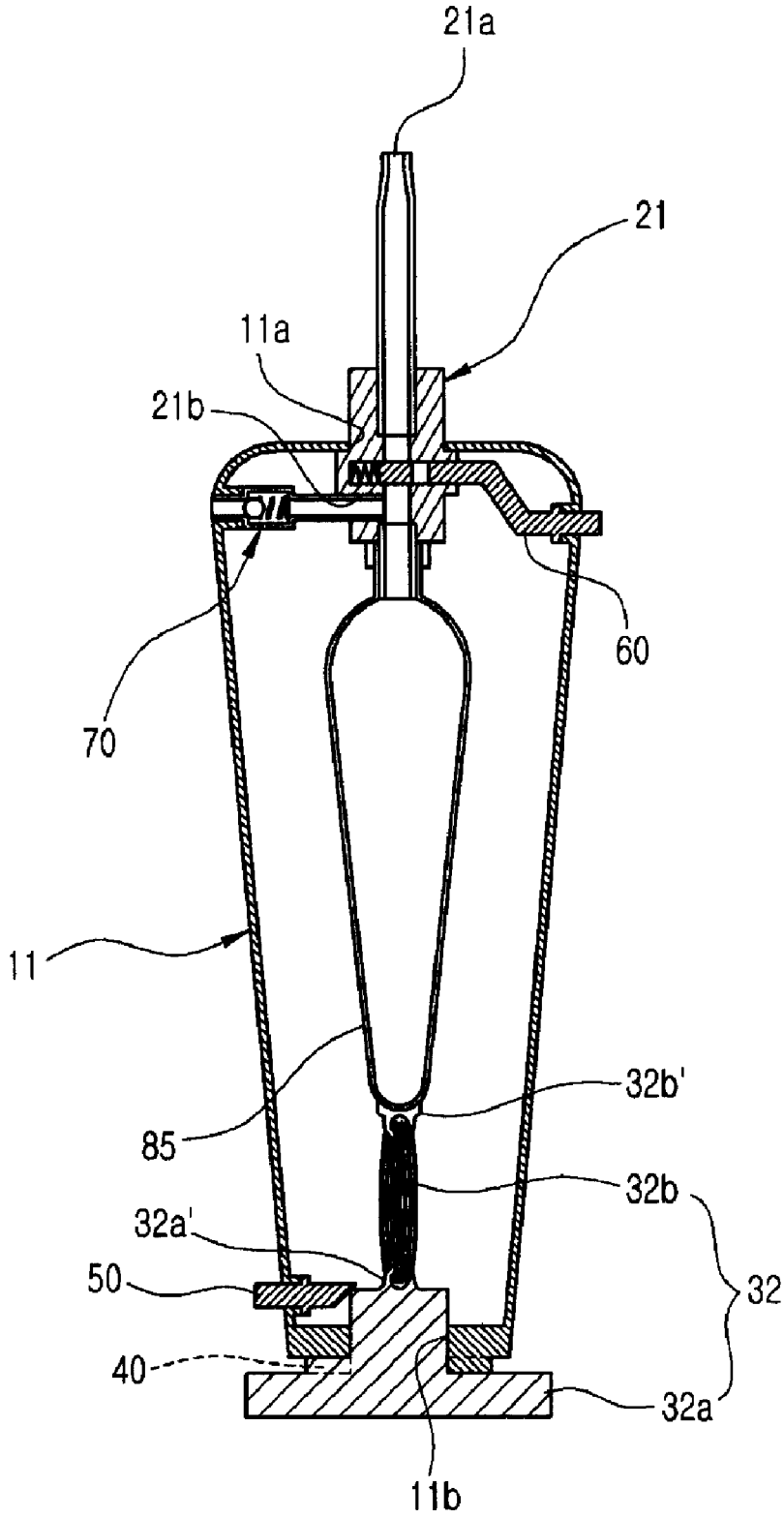

FLUID JETTING APPARATUS

TECHNICAL FIELD

The present invention relates to a fluid jetting apparatus.

BACKGROUND ART

In general, a fluid jetting apparatus is an apparatus that can jet liquid or gas through a nozzle according to a use's manipulation, and is applied to various fields, such as a sprayer, a cosmetic container, an oral cleaner, and so on.

The representative example using the fluid jetting apparatus is the sprayer. Generally, the sprayer includes a container for storing water, a liquid induction tube extendedly disposed in the container, and a jetting apparatus detachably mounted on the container to jet the liquid manually. However, in the conventional sprayer, since the liquid induction tube is not flexible, it cannot suck in the remaining liquid in the inclined container when the liquid filled in the container is consumed in a predetermined amount and only the liquid of a small amount remains. So, the conventional sprayer has a problem in that its use efficiency is deteriorated since a user must refill the sprayer with the liquid on occasion so that the liquid of more than the predetermined amount always remains in the sprayer.

To solve the above problem, an improved sprayer, which has a bellows portion formed at a portion of the liquid induction tube and a weight suspended on an end portion thereof so that the end portion of the liquid induction tube can elastically move together with the liquid when the container is inclined to thereby enhance its use efficiency, has been developed. However, also the improved sprayer has a problem in that the liquid induction tube cannot completely suck in the remaining liquid when the container is completely turned upside down.

That is, devices using the liquid induction tube for sucking the liquid (or gas or gel) to jet the liquid (or gas or gel) have several problems in that it is difficult to all use the liquid filled in the container, and especially, in that it is impossible to use it in any posture.

Furthermore, as another type of the fluid jetting apparatus, there is a water play device for children, in which a container is mounted on the top of the jetting apparatus in such a way as to jet water introduced from the container through a liquid inlet. However, also the water play device for children has a problem in that it cannot jet water since water is not introduced into the liquid inlet in a state where the water play device is inclined when water of a small amount remains in the container.

Meanwhile, in order to provide a stronger jetting force, a fluid jetting apparatus using a piston is also used in various fields. While the fluid jetting apparatus using the piston has a merit in that it can provide the stronger jetting force and use all of the fluid remaining in the container at any angle, the fluid jetting apparatus requires a manufacturing process of the degree of hardship in order to prevent a fluid leakage when the piston performs a reciprocating motion within the container. Moreover, the fluid jetting apparatus using the piston is inconvenient in safe-keeping and carrying since its size is increased as large as a length of the piston protruding from the container when the container is filled with the fluid, and also inconvenient in use since the user has to use his or her two hands in order to jet the fluid.

In addition, as another fluid jetting apparatus, there is a spray container using a compressed gas. The spray container can be used at any angle if a compression force of the compressed gas remains in the container, and provides a strong jetting force and convenience in use. However, the spray container has a problem in that consumers use it as a disposable spray container since to fill the spray container with a high-pressure gas for the strong jetting force must be performed in a factory.

DISCLOSURE OF INVENTION

Technical Problem

Accordingly, the present invention has been made in an effort to solve the above-mentioned problems occurring in the prior arts, and it is an object of the present invention to provide a fluid jetting apparatus, which can jet all remaining fluid of a fluid-storing part at any angle and provide a strong jetting force by using or increasing elasticity of the fluid-storing part for storing the fluid.

Another object of the present invention is to provide a fluid jetting apparatus, which is refilled with a new fluid when the stored fluid is exhausted.

Yet another object of the present invention is to provide a fluid jetting apparatus, which can jet the fluid with a simple manipulation.

Technical Solution

To achieve the above objects, the present invention provides a fluid jetting apparatus using twisting (distortion) of an elastic material, which jets a fluid and has a fluid-storing space using a manual energy formation through a potential energy displacement of the elastic material, wherein the fluid jetting apparatus uses a principle that a displacement occurring by the twisting or distortion of the elastic material achieves a rotatable expansion of the elastic material and the extended length of the elastic material is secured relatively greatly in a narrower space through the rotatable expansion of the elastic material, so that the twisting or distortion forms a potential energy based on elasticity, forms pressure to a fluid, which is stored in the fluid-storing space, by the potential energy, and prevents a coincidence of an energy cumulative period and a pressure working period.

To achieve the above objects, the present invention provides a fluid jetting apparatus comprising: a nozzle having a jetting hole adapted to jet a fluid; a nozzle opening and closing part adapted to open and close the jetting hole; at least one elastic fluid-storing part adapted to store the fluid therein and connected with the nozzle at a portion thereof in such a way as to jet the fluid by its elasticity through the jetting hole, the elastic fluid-storing part increasing elasticity accumulated by receiving the external force; and a pressurizing part adapted to increase elasticity accumulated in the elastic fluid-storing part by applying the force to the elastic fluid-storing part.

Here, the pressurizing part increases elasticity accumulated in the elastic fluid-storing part by expanding the elastic fluid-storing part.

Furthermore, it is preferable that the fluid jetting apparatus further comprises a housing, in which the elastic fluid-storing part is located, the housing having a nozzle mounting hole for mounting the nozzle thereon and a pressurizing part mounting hole for mounting the pressurizing part thereon.

In this instance, the nozzle mounting hole is formed on the housing to allow the nozzle to be detachably mounted on the housing, and allow the elastic fluid-storing part to be filled with the fluid therethrough in a state where the nozzle is separated from the nozzle mounting hole.

Moreover, the nozzle further includes: a filling hole for injecting the fluid into the elastic fluid-storing part; and a filling valve for opening and closing the filling hole.

In addition, it is preferable that a sectional area of a pressurizing part mounting hole side of the housing is narrower than that of an approximately central portion of the housing.

In the meantime, wherein the pressurizing part is rotatably mounted on the pressurizing part mounting hole of the housing and coupled with a portion of the elastic fluid-storing part in such a way as to twist the elastic fluid-storing part by a rotation to thereby increase elasticity accumulated in the elastic fluid-storing part.

Here, it is preferable that the fluid jetting apparatus further comprises: a locking means adapted to rotate the pressurizing part in a one-way direction when the pressurizing part is rotated to increase elasticity accumulated in the elastic fluid-storing part; and a releasing means adapted to release the locking to loose the twisting of the elastic fluid-storing part.

Meanwhile, the pressurizing part includes: a rotatably pressurizing portion rotatably mounted on the pressurizing part mounting hole of the housing; and a pressure transferring member twisted by the rotation of the rotatably pressurizing portion to thereby increase its elasticity and transferring the increased elasticity to the elastic fluid-storing part.

Here, it is preferable that the fluid jetting apparatus further comprises: a locking means adapted to rotate the rotatably pressurizing portion in a one-way direction when the rotatably pressurizing portion is rotated to increase elasticity accumulated in the elastic fluid-storing part; and a releasing means adapted to release the locking to loose the twisting of the elastic fluid-storing part.

Advantageous Effects

As described above, the fluid jetting apparatus according to the present invention can jet various fluids, for instance, liquids such as water and gargle, gases such as helium and oxygen, and gel-type fluids such as toothpaste and hair gel according to use purposes, and if necessary, may be manufactured for a disposable use or a refill use.

Additionally, since the elastic fluid-storing part directly containing the fluid jets the fluid using the elasticity without using an induction tube, the present invention can jet the fluid at any angle and can increase the jetting force of the elastic fluid-storing part even though the fluid of a small quantity remains, thereby jetting the fluid without lowering of the jetting force.

BRIEF DESCRIPTION OF THE DRAWINGS

FIG. 1 is a perspective view of a fluid jetting apparatus according to a first preferred embodiment of the present invention.

FIG. 2 is a schematically sectional view for explaining a configuration of the fluid jetting apparatus of FIG. 1.

FIG. 3 is a view for explaining an operation of the fluid jetting apparatus of FIG. 1.

FIG. 4 is a view for explaining a locking means of the fluid jetting apparatus of FIG. 1.

FIG. 5 is a schematically sectional view of a fluid jetting apparatus according to a second preferred embodiment of the present invention.

FIG. 6 is a schematically sectional view of a fluid jetting apparatus according to a third preferred embodiment of the present invention.

FIG. 7 is a schematically sectional view of a fluid jetting apparatus according to a third preferred embodiment of the present invention.

MODE FOR THE INVENTION

Reference will be now made in detail to the preferred embodiment of the present invention with reference to the attached drawings.

FIG. 1 is a perspective view of a fluid jetting apparatus according to a first preferred embodiment of the present invention, and FIG. 2 is a schematically sectional view for explaining a configuration of the fluid jetting apparatus of FIG. 1. As shown in FIGS. 1 and 2, the fluid jetting apparatus according to the first preferred embodiment of the present invention includes a housing 11, a nozzle 21, a pressurizing part 30, a nozzle opening and closing part 60, a elastic fluid-storing part 81, a filling valve 70, a locking means 40, and a releasing means 50.

The housing 11 includes a nozzle mounting hole 11*a* for mounting the nozzle 21 thereon and a pressurizing part mounting hole 11*b* for mounting the pressurizing part 30 thereon. When the elastic fluid-storing part 81 located inside the housing 11 is twisted, in order to prevent that the inner upper end portion of the housing 11 (namely, the nozzle mounting hole 11*a* side) is first twisted, as shown in FIGS. 1 and 2, it is preferable that the housing 11 is formed in such a way that its section gets narrower toward the pressurizing part mounting hole 11*b*.

The nozzle 21 has a jetting hole 21*a* formed in such a way as to be communicatably expanded from the inside of the housing 11, more concretely, the inside of the elastic fluid-storing part 81 located inside the housing 11, to the outside of the housing 11 for jetting a fluid, and is mounted on the nozzle mounting hole 11*a* of the housing 11. Here, the nozzle 21 is detachably mounted on the nozzle mounting hole 11*a* of the housing 11, and hence, a user can remove the nozzle 21 from the nozzle mounting hole 11*a* of the housing 11 and fill the elastic fluid-storing part 81 within the housing 11 with the fluid through the opened nozzle mounting hole 11*a*. Alternatively, like the first preferred embodiment of the present invention, the nozzle 21 further includes a filling hole 21*b* formed thereon in such a way as to communicate with the elastic fluid-storing part 81, and the filling hole 21*b* is opened and closed by the filling valve 70, so that the user can fill the fluid-storing part 81 with the fluid through the filling hole 21*b* by opening the filling valve 70.

The pressurizing part 30 is rotatably coupled to the pressurizing part mounting hole 11*b* of the housing 11. The pressurizing part 30 is coupled to the pressurizing part mounting hole 11*b* of the housing 11 in such a way as to be rotated endlessly. In this instance, it is preferable that the locking means 40 adapted to prevent a backlash of the pressurizing part 30 after the pressurizing part 30 is rotated to a predetermined rotation frequency and the releasing means 50 adapted to release locking if necessary (to release the twisted state of the elastic fluid-storing part 81 to fill the fluid-storing part with the fluid) are provided.

Here, referring to FIG. 4, the locking means 40 and the releasing means 50 of the fluid jetting apparatus according to the first preferred embodiment of the present invention will be described in more detail. First, the locking means 40 is saw teeth formed on mutually corresponding faces of the housing 11 and the pressurizing part 30. However, since sectional forms of the saw teeth are not symmetric to each other in the opposite directions but all inclined in one direction, the pressurizing part 30 can be rotated in an A direction shown in the drawing but cannot be rotated in the reverse direction due to engagement of the saw teeth. So, in a state where the elastic fluid-storing part 81 is twisted by the rotation of the pressurizing part 30, a reverse rotation of the pressurizing part 30 can be prevented by a reverse rotation force of the elastic fluid-storing part 81. Of course, when it is necessary to refill the elastic fluid-storing part 81 with a new fluid after the fluid stored in the elastic fluid-storing part 81 is all exhausted, the twist of the elastic fluid-storing part 81 must be released. Hence, when the user presses the releasing means 50 as shown in FIG. 5, the locking means 40 is rotated in the reverse direction to release the engagement of the saw teeth, and then, the twist of the elastic fluid-storing part 81 can be released.

The nozzle opening and closing part 60 controls jetting of the fluid by opening and closing the jetting hole 21*a* of the nozzle 21 through the user's manipulation.

In the meantime, the nozzle 21, the nozzle opening and closing part 60, and the filling valve 70 formed on the nozzle 21 can be modified in various forms according to use purposes of the fluid jetting apparatus, namely, according to devices to which the fluid jetting apparatus is applied, such as a sprayer, a cosmetic container, a water play device, an oral cleaner, and so on, and it would be appreciated that the simplest structure is described in this embodiment.

The elastic fluid-storing part 81 is located within the housing 11 for storing the fluid, and has a portion communicated with the jetting hole of the nozzle 21 and the other portion coupled with the pressurizing part 30. Accordingly, when the jetting hole 21*a* of the nozzle 21 is opened, the elastic fluid-storing part 81 elastically jets the stored fluid through the jetting hole 21*a* of the nozzle 21. In this instance, the elastic fluid-storing part 81 may push out the stored fluid to the jetting hole 21*a* by its own elasticity, but as shown in FIG. 3, may provide a stronger jetting force since its elasticity is increased when the elastic fluid-storing part 81 is twisted by the rotation of the pressurizing part 30. Once the fluid is filled in the elastic fluid-storing part 81, the fluid can be used until it is completely exhausted. Here, it is preferable that the elastic fluid-storing part 81 is made of a material of a good elasticity, such as natural/synthetic latex, polyurethane, polypropylene, silicon, and so on.

Hereinafter, referring to FIGS. 1 to 4, operation methods of the fluid jetting apparatus according to the first preferred embodiment of the present invention will be described.

A. Fluid Filling

First, the elastic fluid-storing part 81 is filled with the fluid through the filling hole 21*b* communicated with the jetting hole 21*a* of the nozzle 21. In this instance, the filling valve 70 is opened so that the fluid can be injected to the elastic fluid-storing part 81 easily. Here, the fluid may be one selected from water, gargle, tooth paste, hair gel, helium, oxygen, and so on according to the use purposes of the fluid jetting apparatus.

B. Increase of Elasticity of Elastic Fluid-Storing Part & Jetting of Fluid

After the elastic fluid-storing part 81 is filled with the fluid, when the user presses the nozzle opening and closing part 60 to open the jetting hole 21*a*, the fluid is jet by self-elasticity of the elastic fluid-storing part 81. However, as shown in FIG. 3, when the elastic fluid-storing part 81 is twisted by the rotation of the pressurizing part 30, the elastic fluid-storing part 81 has a stronger elasticity, and so, the fluid jetting force is also increased when the jetting hole 21*a* is opened.

When the pressurizing part 30 is rotated, as shown in FIG. 4, since the housing 11 and the pressurizing part 30 are coupled with each other via the locking means 40 (saw teeth), the backlash of the pressurizing part 30 can be prevented even though a reversely rotating force acts on the elastic fluid-storing part 81 after the predetermined rotation frequency of the pressurizing part 30.

Furthermore, gears of different sizes (not shown) may be provided in such a way that the elastic fluid-storing part 81 can be rotated many times by the small size gear when the user rotates the large size gear with a large power to thereby provide convenience in use.

In addition, in order to conveniently rotate the pressurizing part 30, a foldable lever (not shown) may be hinge-coupled to a side of the pressurizing part 30 and mounted on the housing 11, whereby a great rotational force can be provided by the lever when the pressurizing part 30 is rotated.

Moreover, the fluid can be jet only by a pressing action of the nozzle opening and closing part 60 in a state where elasticity of the elastic fluid-storing part 81 is increased. If the user feels that the jetting force is weakened during the use, elasticity of the elastic fluid-storing part 81 can be increase when the user rotates the pressurizing part 30 again. That is, the fluid jetting apparatus according to the present invention can provide the strong jetting force until the residue of the fluid is all exhausted.

Meanwhile, not only the method to increase elasticity by twisting the elastic fluid-storing part using the pressurizing part but also a method to expand or contract the elastic fluid-storing part like a piston action may be considered. That is, it would be appreciated that also the method to increase elasticity of the elastic fluid-storing part by expanding the elastic fluid-storing part (to increase a surface area by pressurizing the elastic fluid-storing part) belongs to the scope of the present invention.

C. Refill of Fluid

When the fluid stored in the elastic fluid-storing part 81 is all exhausted and it is necessary to refill the elastic fluid-storing part 81 with the new fluid, the twist of the elastic fluid-storing part 81 twisted by the pressurizing part 30 must be released. So, when the user presses the releasing means 50 to release the engagement of the locking means, 40, namely, the saw teeth, the pressurizing part 30 is reversely rotated by the reversely rotating force of the elastic fluid-storing part 81 to thereby release the twisted state of the elastic fluid-storing part 81, or the user rotates the pressurizing part 30 reversely to release the twisted state of the elastic fluid-storing part 81. In the above state, the elastic fluid-storing part 81 can be filled with the fluid through the filling hole 21*b*.

In the meantime, in this embodiment, the simplest structure of the nozzle 21 is described, but the nozzle 21 may have an impeller (not shown) located within the jetting hole and having asymmetrically formed holes to form a pulsating flow, so that the user can feel a strong jetting force for a long time.

As described above, if a nozzle side of the elastic fluid-storing part 81 is first twisted, since the fluid stored in a portion of the elastic fluid-storing part 81 located below the nozzle side cannot be jet, a pressurizing part mounting hole 11*b* side of the elastic fluid-storing part 81 must be first twisted. So, it is preferable that the housing 11 is manufactured in such a way that a sectional area of an approximately central portion of the housing 11 is narrower than that of the pressurizing part mounting hole side.

In addition, since the pressurizing part mounting hole side of the elastic fluid-storing part 81 may be worn away easier than other portions of the elastic fluid-storing part 81 because of the repeated twisting and release, it is preferable that the repeatedly twisted and released portion, namely, the pressurizing part mounting hole side of the elastic fluid-storing part 81, is formed thicker than the nozzle mounting hole side of the elastic fluid-storing part 81 when the elastic fluid-storing part 81 is manufactured.

As shown in FIGS. 1 to 4, the elastic fluid-storing part 81 may be formed in such a way that the lower portion (the pressurizing part mounting hole side) of the elastic fluid-storing part 81 is first twisted by changing the form of the housing 11 or the elastic fluid-storing part 81. On the other hand, like a fluid jetting apparatus according to a second preferred embodiment of the present invention shown in FIG. 5, a plurality of elastic fluid-storing part 82 and 83 are provided to completely prevent that the nozzle mounting hole side is first twisted, or like fluid jetting apparatuses according to third and fourth preferred embodiments of the present invention shown in FIGS. 6 and 7, pressurizing parts 31 and 32 respectively include rotatably pressurizing portions 31*a* and 32*a* and pressure transferring members 31*b* and 32*b*, so that the pressure transferring members 31*b* and 32*b* are twisted before elastic fluid-storing parts 84 and 85.

Referring to FIG. 5, the fluid jetting apparatus according to the second preferred embodiment of the present invention includes a housing 12, a nozzle 22, a pressurizing part 30, a nozzle opening and closing part 60, two elastic fluid-storing parts 82 and 83, a filling valve 70, a locking means 40, and a releasing means 50.

The fluid jetting apparatus according to the second preferred embodiment includes the two elastic fluid-storing parts 82 and 83, and they are coupled to the nozzle 22 and the nozzle 22 and the pressurizing part 30. So, if a size of the housing 12 having a nozzle mounting hole 12*a* and a pressurizing part mounting hole 12*b* is not changed, elasticity of the two elastic fluid-storing parts 82 and 83 is stronger than that of one elastic fluid-storing part within a restricted space, and hence, the fluid jetting apparatus according to the second preferred embodiment can provide a better jetting force. In this instance, while two nozzles may be respectively coupled to the elastic fluid-storing parts 82 and 83 in order to inject different fluids to the respective elastic fluid-storing parts 82 and 83, the two elastic fluid-storing parts 82 and 83 are all coupled to the one nozzle 22 having a jetting hole 22*a* and a filling hole 22*b* in this embodiment. Furthermore, since the two elastic fluid-storing parts 82 and 83 are arranged vertically, narrower pressurizing part sides of the two elastic fluid-storing parts 82 and 83 are first twisted when the pressurizing part 30 is rotated.

Here, since the nozzle opening and closing part 60, the filling valve 70, the locking means 40 and the releasing means 50 are described in detail in the first preferred embodiment, repeated descriptions thereof will be omitted.

FIG. 6 illustrates the fluid jetting apparatus according to the third preferred embodiment of the present invention. As shown in FIG. 6, the fluid jetting apparatus includes a housing 11, a nozzle 21, a pressurizing part 31, a nozzle opening and closing part 60, a elastic fluid-storing part 84, a filling valve 70, a locking means 40, and a releasing means 50.

Unlike the fluid jetting apparatuses according to the first and second preferred embodiments, the fluid jetting apparatus according to the third preferred embodiment includes the pressurizing part 31 having a rotatably pressurizing portion 31*a* and a pressure transferring member 31*b*.

The rotatably pressurizing portion 31*a* is rotatably mounted on the pressurizing part mounting hole 11*b* of the housing 11, and the pressure transferring member 31*b* is twisted by the rotation of the rotatably pressurizing portion 31*a* in such a way as to be increased in its elasticity and transfers the increased elasticity to the elastic fluid-storing part 84. In this instance, the pressure transferring member 31*b* surrounds the elastic fluid-storing part 84 and is coupled to the rotatably pressurizing portion 31*a* at a point thereof. Since the elastic fluid-storing part 84 is not first twisted, the present invention can previously prevent a malfunction, for instance, the stored fluid is not jet. Moreover, in order to transfer the elasticity to the elastic fluid-storing part 84 to the utmost by the twist, it is preferable that the pressure transferring member 31*b* is also made of a material with good elasticity.

Since the nozzle 21, the nozzle opening and closing part 60, the filling valve 70, the locking means 40 and the releasing means 50 are described in detail in the first preferred embodiment, repeated descriptions thereof will be omitted.

In the meantime, the fluid jetting apparatus according to the fourth preferred embodiment of the present invention includes a housing 11, a nozzle 21, a pressurizing part 32, a nozzle opening and closing part 60, the elastic fluid-storing part 85, a filling valve 70, a locking means 40, and a releasing means 50.

Like the fluid jetting apparatus according to the third preferred embodiment, the pressurizing part 32 of the fluid jetting apparatus according to the fourth preferred embodiment includes a rotatably pressurizing portion 32*a* and a pressure transferring member 32*b*. However, the pressure transferring member 32*b* in the fourth preferred embodiment does not surround the elastic fluid-storing part 85 to transfer a pressure but just provides a basis that the pressurizing part 32 can be first twisted. That is, a side of the pressure transferring member 32*b* is connected with a point of the elastic fluid-storing part 85 via a connection clip 32*b*' and the other side is coupled to the rotatably pressurizing portion 32*a*, so that the pressurizing part 32 is first twisted by the rotation of the rotatably pressurizing portion 32*a*, whereby the pressurizing part 32 transfers its elasticity to the elastic fluid-storing part 85. In this instance, the rotatably pressurizing part 32*a* may include a connection hole 32*a*' adapted to make coupling between the rotatably pressurizing portion 32*a* and the pressure transferring member 32*b* easy.

Of course, since the twist is mainly formed on the pressure transferring member 32*b*, it is preferable that the pressure transferring member 32*b* is also made of a material with good elasticity. For the simplest example, an elastic cord, which is circulated in the market, may be used as the pressure transferring member.

Since the fluid jetting apparatus according to the fourth preferred embodiment transfers the increased elasticity of the pressure transferring member 32*b* twisted by the rotation of the rotatably pressurizing portion 32*a* to a point of the elastic fluid-storing part 85, it never occurs that the upper end portion of the elastic fluid-storing part 85 is first twisted. Furthermore, the elasticity may be changed by changing the thickness or the material of the pressure transferring member 32*b*, and it may be properly changed according to use purposes or the user's intention (for an adult use and for an infant use). In addition, the repeated twist and release may cause an abrasion, and in this instance, if the elastic fluid-storing part is worn away due to its repeated twist and release, it is complicated to be replaced with a new one. However, in the fluid jetting apparatus according to the fourth preferred embodiment, since the pressure transferring member 32*b* is mainly twisted, it is possible to replace only the pressure transferring member 32*b* when abrasion occurs.

In the meantime, since the nozzle 21, the nozzle opening and closing part 60, the filling valve 70, the locking means 40 and the releasing means 50 are described in detail in the first preferred embodiment, repeated descriptions thereof will be omitted.

As described above, the fluid jetting apparatus according to the present invention can jet various fluids, for instance, liquids such as water and gargle, gases such as helium and oxygen, and gel-type fluids such as toothpaste and hair gel according to use purposes, and if necessary, may be manufactured for a disposable use or a refill use.

Additionally, since the elastic fluid-storing part directly containing the fluid jets the fluid using the elasticity without using an induction tube, the present invention can jet the fluid at any angle and jet the fluid without any decrease of the jetting force even though the fluid of a small quantity remains.

As an application example of the fluid jetting apparatus according to the present invention, there is an oral cleaner. If a tooth brush mounting part adapted for detachably mounting a tooth brush thereto is mounted on the outer surface of the housing and the elastic fluid-storing part is filled with a cleaning solution (water), when the user wants to check his or her oral state while brushing his or her teeth, the user can see his or her oral state through a mirror after rinsing a wanted teeth portion with water only by pressing the nozzle opening and closing part. Of course, an electric oral cleaner having the above operation is already showed up in the market, but the fluid jetting apparatus according to the present invention will not lose in the competition with the electric oral cleaner since the fluid jetting apparatus does not need a battery or other power source and is very low-priced.

Additionally, in connection with novelty, inventiveness and background of the present invention, it is necessary to recognize characteristics of other manual type apparatuses using an elastic energy and compare the present invention with the manual type apparatuses.

As an apparatus, which is the most similar to the present invention, there is proposed an apparatus, in which a pressurizing means expands a fluid-storing space using an elastic energy (potential energy) of an elastic material, such as a spring, and the expanded location of the fluid-storing space is set by a rising location of the potential energy. However, such an apparatus have the following problems.

That is, the apparatus has a problem in a displacement length of the elastic material for accumulating energy and in security of space. Namely, if the space is not secured sufficiently, due to properties of the elastic energy, the apparatus needs power increasing by geometric progression as a time point when the energy increases goes from the initial stage to the latter stage, and so, power rapidly drops also when the energy is recovered to a lower position. In other words, since a sufficient length or space must be secured in order to keep a relatively uniform pressure, the entire length of the housing is enlarged. Therefore, as a standard for judging novelty and inventiveness of the present invention in comparison with the above-mentioned apparatus according to the prior arts, the fluid jetting apparatus according to the present invention uses the twisting (distortion) having two properties to maximize a length of an expanded face through a rotational motion in a restricted space and to displace the twisting in a direction to reduce a volume. Accordingly, the fluid jetting apparatus is differentiated from the apparatuses using elastic energy (potential energy) in that it is simple in manufacturing and in that it can provide sufficient elasticity without an unnecessarily large storing space.

As describe above, in case where an elastic material (spring) using a longitudinal movement, since a large power is needed when the elastic material is compressed to accumulate energy, a great power is needed in case of a hand-manipulated device, or a reduction gear unit for an energy movement is needed. Therefore, the apparatus using elastic energy has several problems in that it is inconvenient in use, needs high-strength structure and design, and is very complicated in structure. Furthermore, in case where the apparatus is out of order or in error, the user's injury caused by the previously accumulated energy, such as explosion (for instance, explosion occurring by bouncing-out of the spring in a state where a great energy is accumulated) or sudden transformation. Accordingly, the apparatus using elastic energy is inadequate for low-priced and small-sized products of a high frequency in use, such as the oral cleaner or a combined oral cleaner and tooth brush.

Moreover, as a representative device in a different field using a principle similar to the present invention, there is a rubber motor airplane (for learning) using an elastic cord. The rubber motor airplane just uses a great elasticity-storing capacity of a distortion motion. While the rubber motor airplane is not an attempt to contain the fluid therein but is a good example, which makes the best use of properties of elastic energy.

Meanwhile, in the fluid jetting apparatus according to the present invention, a method of expanding the elastic fluid-storing part by directly connecting the elastic fluid-storing part to the pressurizing part or by pulling out and winding the elastic fluid-storing part (or the pressure transferring member) through the rotation of the pressurizing part (or the rotatably pressurizing portion) in a state where the pressurizing part having the rotatably pressurizing portion and the pressure transferring member is connected to the elastic fluid-storing part, namely, a method of increasing elasticity by expanding the elastic fluid-storing part may be considered sufficiently.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention.

INDUSTRIAL APPLICABILITY

As described above, the fluid jetting apparatus according to the present invention can jet various fluids, for instance, liquids such as water and gargle, gases such as helium and oxygen, and gel-type fluids such as toothpaste and hair gel according to use purposes, and if necessary, may be manufactured for a disposable use or a refill use.

Additionally, since the elastic fluid-storing part directly containing the fluid jets the fluid using the elasticity without using an induction tube, the present invention can jet the fluid at any angle and can increase the jetting force of the elastic fluid-storing part even though the fluid of a small quantity remains, thereby jetting the fluid without lowering of the jetting force.

The invention claimed is:

1. A fluid jetting apparatus comprising: a nozzle having a jetting hole adapted to jet a fluid; a nozzle opening and closing part adapted to open and close the jetting hole; at least one elastic fluid-storing part adapted to store the fluid therein and connected with the nozzle at a portion thereof in such a way as to jet the fluid by its elasticity through the jetting hole, the elastic fluid-storing part increasing elasticity accumulated by receiving an external force; and a pressurizing part adapted to increase elasticity accumulated in the elastic fluid-storing part by applying the external force to the elastic fluid-storing part, wherein the pressurizing part increases elasticity accumulated in the elastic fluid-storing part by expanding the elastic fluid-storing part, the fluid jetting apparatus further comprising a housing, in which the elastic fluid-storing part is located, the housing having a nozzle mounting hole for mounting the nozzle thereon and a pressurizing part mounting hole for mounting the pressurizing part thereon.

2. The fluid jetting apparatus according to claim 1, wherein the nozzle mounting hole is formed on the housing to allow the nozzle to be detachably mounted on the housing, and allow the elastic fluid-storing part to be filled with the fluid therethrough in a state where the nozzle is separated from the nozzle mounting hole.

3. The fluid jetting apparatus according to claim 2, wherein the pressurizing part includes: a rotatably pressurizing portion rotatably mounted on the pressurizing part mounting hole of the housing; and a pressure transferring member twisted by the rotation of the rotatably pressurizing portion to thereby increase its elasticity and transferring the increased elasticity to the elastic fluid-storing part.

4. The fluid jetting apparatus according to claim 3, further comprising: a locking means adapted to rotate the rotatably pressurizing portion in a one-way direction when the rotatably pressurizing portion is rotated to increase elasticity accumulated in the elastic fluid-storing part; and a releasing means adapted to release the locking to loosen the twisting of the elastic fluid-storing part.

5. The fluid jetting apparatus according to claim 2, wherein the pressurizing part is rotatably mounted on the pressurizing part mounting hole of the housing and coupled with a portion of the elastic fluid-storing part in such a way as to twist the elastic fluid-storing part by a rotation to thereby increase elasticity accumulated in the elastic fluid-storing part.

6. The fluid jetting apparatus according to claim 5, further comprising: a locking means adapted to rotate the pressurizing part in a one-way direction when the pressurizing part is rotated to increase elasticity accumulated in the elastic fluid-storing part; and a releasing means adapted to release the locking to loosen the twisting of the elastic fluid-storing part.

7. The fluid jetting apparatus according to claim 1, wherein the nozzle further includes: a filling hole for injecting the fluid into the elastic fluid-storing part; and a filling valve for opening and closing the filling hole.

8. The fluid jetting apparatus according to claim 7, wherein the pressurizing part is rotatably mounted on the pressurizing part mounting hole of the housing and coupled with a portion of the elastic fluid-storing part in such a way as to twist the elastic fluid-storing part by a rotation to thereby increase elasticity accumulated in the elastic fluid-storing part.

9. The fluid jetting apparatus according to claim 8, further comprising: a locking means adapted to rotate the pressurizing part in a one-way direction when the pressurizing part is rotated to increase elasticity accumulated in the elastic fluid-storing part; and a releasing means adapted to release the locking to loosen the twisting of the elastic fluid-storing part.

10. The fluid jetting apparatus according to claim 7, wherein the pressurizing part includes: a rotatably pressurizing portion rotatably mounted on the pressurizing part mounting hole of the housing; and a pressure transferring member twisted by the rotation of the rotatably pressurizing portion to thereby increase its elasticity and transferring the increased elasticity to the elastic fluid-storing part.

11. The fluid jetting apparatus according to claim 10, further comprising: a locking means adapted to rotate the rotatably pressurizing portion in a one-way direction when the rotatably pressurizing portion is rotated to increase elasticity accumulated in the elastic fluid-storing part; and a releasing means adapted to release the locking to loosen the twisting of the elastic fluid-storing part.

12. The fluid jetting apparatus according to claim 1, wherein a sectional area of a pressurizing part mounting hole side of the housing is narrower than that of an approximately central portion of the housing.

13. The fluid jetting apparatus according to claim 12, wherein the pressurizing part is rotatably mounted on the pressurizing part mounting hole of the housing and coupled with a portion of the elastic fluid-storing part in such a way as to twist the elastic fluid-storing part by a rotation to thereby increase elasticity accumulated in the elastic fluid-storing part.

14. The fluid jetting apparatus according to claim 13, further comprising: a locking means adapted to rotate the pressurizing part in a one-way direction when the pressurizing part is rotated to increase elasticity accumulated in the elastic fluid-storing part; and a releasing means adapted to release the locking to loosen the twisting of the elastic fluid-storing part.

15. The fluid jetting apparatus according to claim 12, wherein the pressurizing part includes: a rotatably pressurizing portion rotatably mounted on the pressurizing part mounting hole of the housing; and a pressure transferring member twisted by the rotation of the rotatably pressurizing portion to thereby increase its elasticity and transferring the increased elasticity to the elastic fluid-storing part.

16. The fluid jetting apparatus according to claim 15, further comprising: a locking means adapted to rotate the rotatably pressurizing portion in a one-way direction when the rotatably pressurizing portion is rotated to increase elasticity accumulated in the elastic fluid-storing part; and a releasing means adapted to release the locking to loosen the twisting of the elastic fluid-storing part.

* * * * *